US009790073B2

(12) United States Patent
Klotz et al.

(10) Patent No.: US 9,790,073 B2
(45) Date of Patent: Oct. 17, 2017

(54) FILLING MACHINE

(71) Applicant: KHS GmbH, Dortmund (DE)

(72) Inventors: Matthias Klotz, Bad Kreuznach (DE); Thomas Niehr, Bad Münster am Stein Ebernburg (DE); Jürgen Vorwerk, Mönsdorf (DE)

(73) Assignee: KHS GmbH, Dortmund (DE)

( * ) Notice: Subject to any disclaimer, the term of this patent is extended or adjusted under 35 U.S.C. 154(b) by 49 days.

(21) Appl. No.: 14/440,986

(22) PCT Filed: Nov. 14, 2013

(86) PCT No.: PCT/EP2013/003427
§ 371 (c)(1),
(2) Date: May 6, 2015

(87) PCT Pub. No.: WO2014/086459
PCT Pub. Date: Jun. 12, 2014

(65) Prior Publication Data

US 2015/0298954 A1 Oct. 22, 2015

(30) Foreign Application Priority Data

Dec. 4, 2012 (DE) ..... 10 2012 111 748

(51) Int. Cl.
*B67C 3/00* (2006.01)
*B67C 3/22* (2006.01)

(52) U.S. Cl.
CPC ..... *B67C 3/004* (2013.01); *B67C 3/225* (2013.01)

(58) Field of Classification Search
CPC ..... B67C 3/004; B67C 3/02; B67C 3/225; B67C 2003/228; B67C 2003/2694
(Continued)

(56) References Cited

U.S. PATENT DOCUMENTS

2005/0172580 A1* 8/2005 Krulitsch ..... B67C 3/004 53/471
2009/0165889 A1* 7/2009 Maubois ..... B67C 3/001 141/91

(Continued)

FOREIGN PATENT DOCUMENTS

DE 10 2004 004 331 9/2005
DE 10 2010 027 624 1/2012

(Continued)

*Primary Examiner* — Timothy L Maust
*Assistant Examiner* — Andrew Schmid
(74) *Attorney, Agent, or Firm* — Occhiuti & Rohlicek LLP

(57) ABSTRACT

A filling machine comprises a rotor driven by a drive around a machine axis surrounded by a pitch circle on the rotor, filling elements provided at even pitch intervals around the pitch circle, a closure-element supporting-ring surrounding and concentric with the machine axis, closure elements, a filling-material discharge opening, and a locking device. Each closure element closes a corresponding filling element on an underside thereof during cleaning or disinfection of said filling machine. Relative movement between the ring and the rotor, which is generated by the drive, moves the closure elements between a non-engaged state, in which the closure elements are between filling elements on the pitch circle, and an engaged state, in which the closure elements are on an underside of a corresponding filling element. The locking device causes this state transition by blocking co-rotation of the ring and the rotor.

13 Claims, 8 Drawing Sheets

(58) Field of Classification Search
USPC ..... 141/89–93
See application file for complete search history.

(56) References Cited

U.S. PATENT DOCUMENTS

| | | | | |
|---|---|---|---|---|
| 2010/0107557 | A1* | 5/2010 | Macquet | B67C 3/004 53/266.1 |
| 2015/0232283 | A1* | 8/2015 | Bruch | B65G 45/22 198/493 |

FOREIGN PATENT DOCUMENTS

| | | |
|---|---|---|
| EP | 1 512 663 | 3/2005 |
| EP | 1 577 258 | 9/2005 |
| FR | 2 950 609 | 4/2011 |
| JP | 2001 031193 | 2/2001 |

* cited by examiner

FILLING MACHINE

RELATED APPLICATIONS

This application is the U.S. national stage of international application PCT/EP2013/003427, filed on Nov. 14, 2013, which claims the benefit of the Dec. 4, 2012 filing date of German application DE 10-2012-111-748.9, the contents of which are herein incorporated by reference.

FIELD OF INVENTION

The invention relates to a filling machine.

BACKGROUND

Known filling machines include those with a rotor that can be driven to rotate about a vertical machine axis, and filling elements on the periphery of the rotor. A supporting ring arranged coaxially with a machine axis carries interchangeable components, such as bottle neck receivers, and closure elements for closing the filling elements during cleaning and/or disinfection thereof. By turning the supporting ring relative to the rotor with a separate drive, the interchangeable components can be moved under control between a non-engaged position, in which the interchangeable components are arranged between the filling elements and to the side thereof, and an engaged position, in which the interchangeable components are situated below corresponding filling elements. The movement of the supporting ring relative to the rotor is achieved by an additional controllable drive that is also configured to turn the supporting ring in two different rotation directions.

SUMMARY OF THE INVENTION

The invention provides a closure-element supporting-ring that supports closure elements and that is distinguished by its simplified construction. The ring is thus more reliable in operation.

In one aspect, the invention features a filling machine that comprises a rotor driven by a drive around a machine axis surrounded by a pitch circle on the rotor, filling elements provided at even pitch intervals around the pitch circle, a closure-element supporting-ring surrounding and concentric with the machine axis, closure elements, a filling-material discharge opening, and a locking device. Each closure element closes a corresponding filling element on an underside thereof during cleaning or disinfection of the filling machine. Relative movement between the ring and the rotor, which is generated by the drive, moves the closure elements between a non-engaged state, in which the closure elements are between filling elements on the pitch circle, and an engaged state, in which the closure elements are on an underside of a corresponding filling element. The locking device causes this state transition by blocking co-rotation of the ring and the rotor.

In another aspect, the invention features an apparatus comprising a filling machine for filling containers with a filling material. The filling machine includes a rotor, filling elements, a closure-element supporting-ring, closure elements, a filling-material discharge opening, and a locking device. The rotor defines a vertical machine axis and a pitch circle that surrounds and is concentric with the machine axis. A rotor drive drives the rotor to rotate it about the machine axis. The filling elements are provided on the rotor at even pitch intervals on the pitch circle. The closure-element supporting-ring is concentric with the machine axis. Each closure element closes a corresponding filling element on an underside thereof during either cleaning or disinfection of the filling machine. Each filling element comprises a filling material discharge opening. Relative movement between the closure-element supporting-ring and the rotor moves the closure elements between a non-engaged state and an engaged state. In the non-engaged state, the closure elements are arranged on the pitch circle between the filling elements. In the engaged state, each closure element is situated on an underside of a corresponding filling element. Relative movement between the closure-element supporting-ring and the rotor is generated by the rotor drive. Meanwhile, the locking device is configured to block co-rotation of the closure-element supporting-ring and the rotor in order cause the closure elements to transition between the non-engaged state and the engaged state.

In some embodiments, the locking device is one of a plurality of locking devices distributed about machine axis, each of which can block co-rotation of the closure-element supporting-ring and the rotor in order cause the closure elements to transition between the non-engaged state and the engaged state.

In other embodiments, the closure-element supporting-ring is connected to the rotor so that rotation of the rotor results in rotation of the closure-element supporting ring. Among these embodiments are those in which the closure-element supporting-ring is connected to the rotor by friction engagement, those in which it is connected to the rotor by sprung locking, and those in which it is connected to the rotor by a controllable coupling device.

In some embodiments, the closure-element supporting-ring lies on a counter-bearing of the rotor with a bearing element that protrudes radially, relative to the vertical machine axis, from the closure-element supporting-ring. In these embodiments, the counter-bearing is an annular structure that surrounds the machine axis.

Other embodiments include a docking device that connects the first fluid channel to a second fluid channel for drainage of the fluid when the closure-element supporting-ring is blocked. In these embodiments, the closure-element supporting-ring comprises a first fluid channel that connects to openings on a closure element for discharge or supply of fluid. The fluid is either condensate, cleaning medium, or disinfection medium.

Some embodiments include a docking device that forms part of a second fluid channel that is provided on a structure that does not rotate with the rotor. In these embodiments, the closure-element supporting-ring comprises a first fluid channel that connects to openings on a closure element for discharge or supply of fluid. The second fluid channel permits discharge of the fluid, which can be condensate, cleaning medium, or disinfection medium. Among these embodiments are those in which the structure that does not rotate with the rotor comprises a machine frame.

Some embodiments include a structure disposed in a dead-angle area of rotary movement of the rotor. This dead-angle area is between a container inlet and a container outlet. The structure is either the locking device or a docking device.

Also among the embodiments are those in which the number of closure elements is equal to the number of filling elements, those in which the closure-element supporting-ring is arranged inside the pitch circle, and those in which the closure elements are arranged at a level between undersides of the filling elements and a container carrier level.

Among the advantages of the filling machine are that no additional drive is required for moving the closure elements between their non-engaged position and their engaged position because the relative movement necessary for this is generated by the rotor or its drive, with the rotor being moved preferably exclusively in one and the same direction of rotation i.e. in its normal direction of rotation.

Preferably, the closure-element supporting-ring is configured with at least one fluid channel that is connected to openings of the closure element and that can be docked onto at least one external fluid channel provided on a machine frame. In this way, treatment medium can be discharged, or, where applicable, also supplied without the need for performing a rotation for these media.

As used herein, "substantially" or "approximately" imply deviations from the precise value by ±10%, preferably by ±5%, and/or deviations in the form of changes insignificant to function.

As used herein, "treatment medium" refers to cleaning, disinfecting and/or sterilization media, including CIP media and SIP media, including, for example, steam and/or hot water.

Refinements, advantages and possible applications of the invention arise from the description below of exemplary embodiments and from the figures. All features described and/or shown in the figures, alone or in any combination, in principle form the subject of the invention irrespective of their summary in the claims or back reference. The content of the claims is hereby declared a constituent part of the description.

BRIEF DESCRIPTION OF THE DRAWINGS

The invention is explained in more detail below with reference to one exemplary embodiment shown in the figures. The figures show.

DETAILED DESCRIPTION

Figure 1:
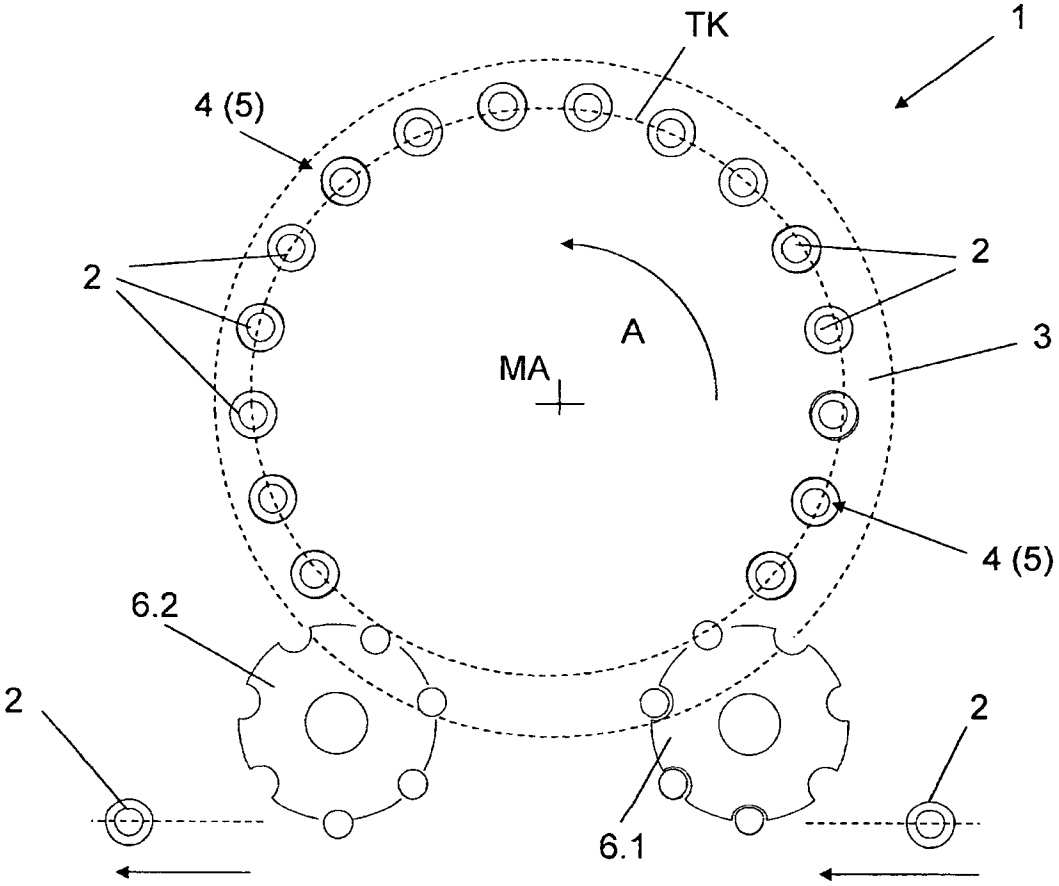
FIG. 1 shows a top view of a filling machine for filling containers with a liquid filling material.

Referring to FIG. 1, a filling machine 1 fills containers 2, such as bottles, with a liquid filling material. The filling machine 1 has a rotor 3 that can be driven to rotate in a rotation direction A about a vertical machine axis MA. On its periphery, the rotor 3 has filling positions 4.

Figure 5:
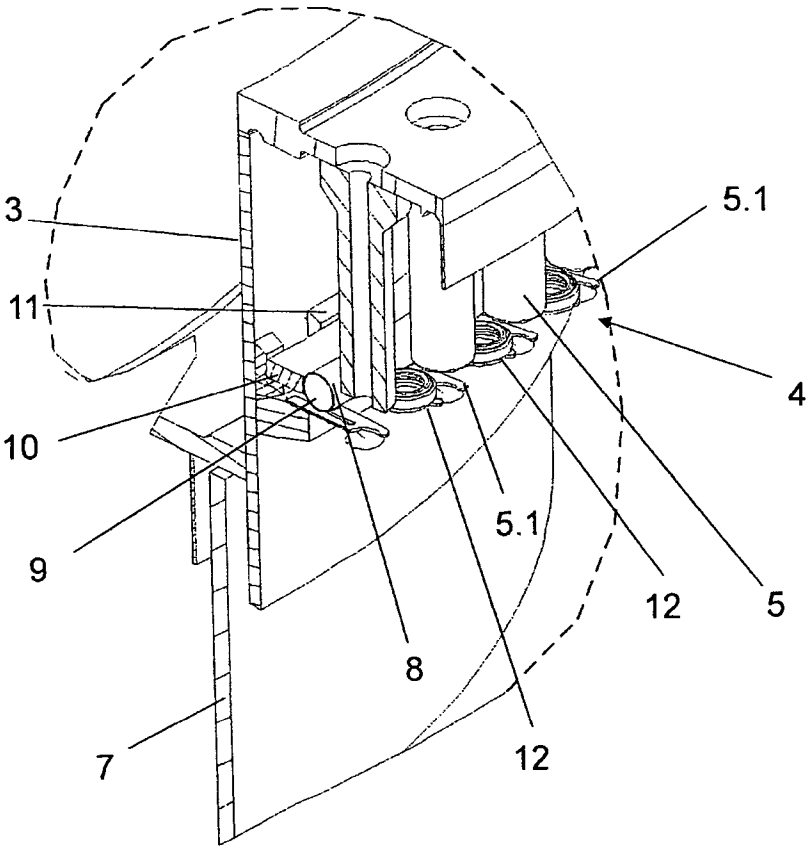
FIG. 5 is a cut-away view of a part of the rotor and the machine frame corresponding to area marked "I" in FIG. 3.

Each filling position 4 comprises a filling valve or filling element 5 and a container carrier 5.1, shown in FIG. 5, for suspending the container 2. The filling positions 4 or filling elements 5 are arranged with their axes oriented parallel to a machine axis MA and at a constant pitch spacing on a pitch circle TK. On its underside, each filling element 5 has at least one filling material outlet opening. The containers 2 to be filled are supplied to the filling positions 4 via a container inlet 6.1, shown in FIG. 1. The filled containers 2 are extracted from the filling positions 4 at the container outlet 6.2.

Figure 2:
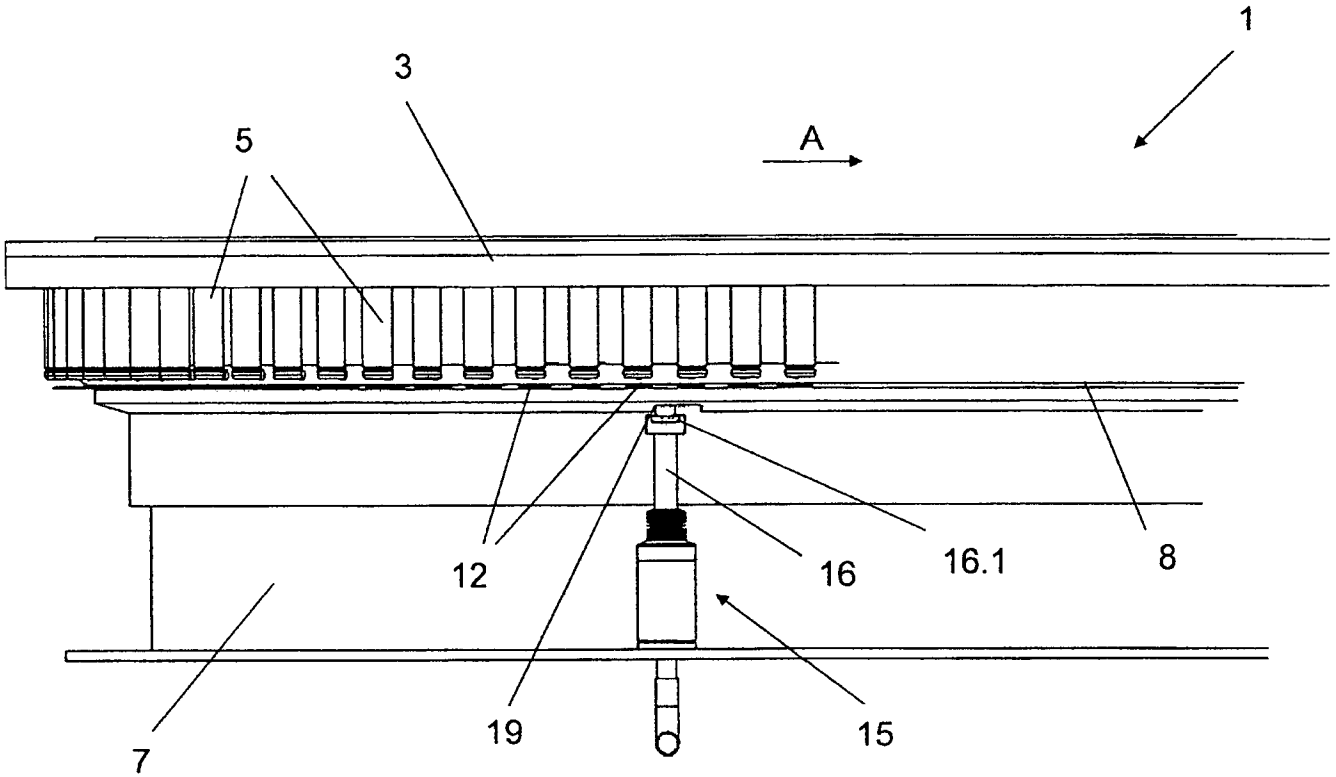
FIG. 2 is a side view of a rotor of the filling machine of FIG. 1, together with a machine frame that does not rotate with the rotor.
Figure 3:
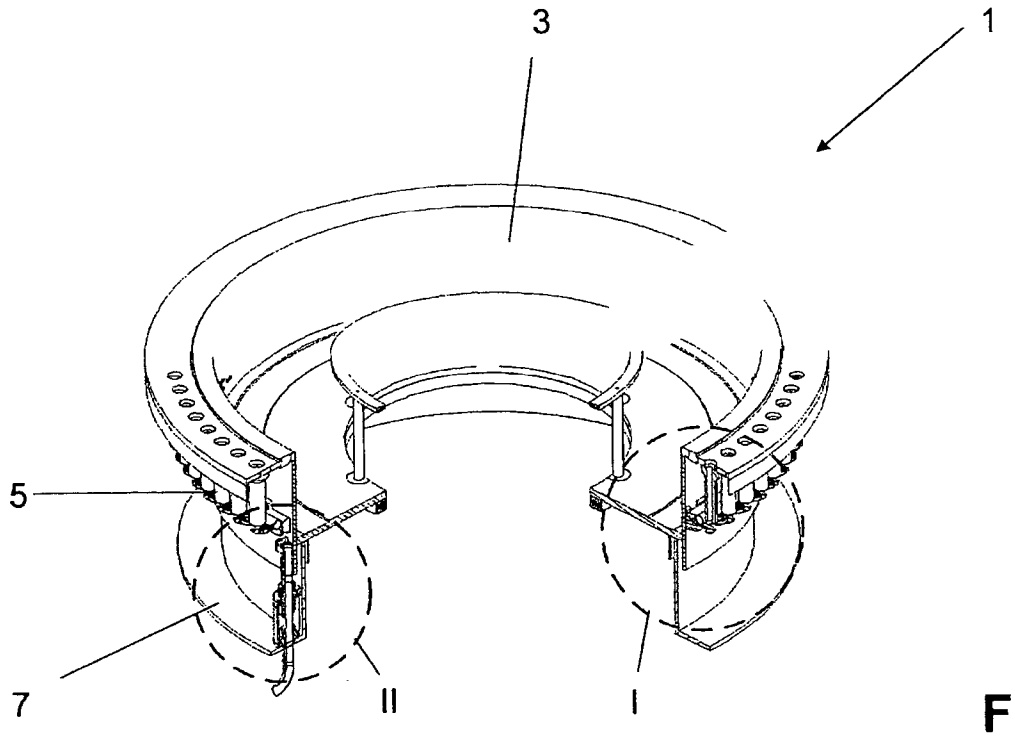
FIG. 3 is a perspective view of the rotor and the machine frame, which does not rotate with the rotor.
Figure 4:
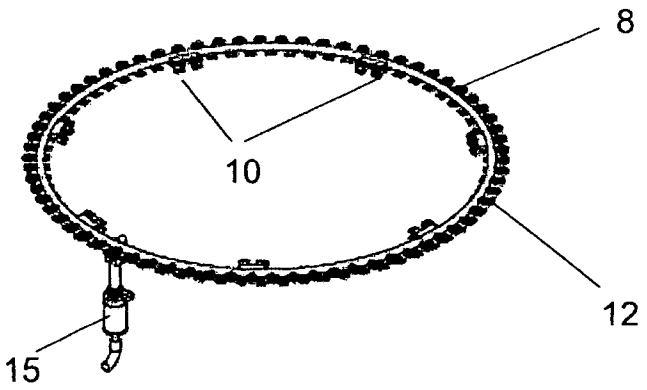
FIG. 4 shows a closure-element supporting-ring with a plurality of closure elements or rinsing caps of the filling machine of FIG. 1.

The filling machine 1 also includes a circular closure-element supporting-ring 8, which is shown in FIGS. 2 and 4. The closure-element supporting-ring 8, which is centered about an axis that is coaxial with the machine axis MA, is mounted so as to rotate about the machine axis MA on a machine frame 7 that does not rotate with the rotor 3. In the embodiment shown, the closure-element supporting-ring 8 is a closed tubular piece formed into a circular ring that defines an annular fluid channel 9, shown in FIG. 5.

In the embodiment shown, the closure-element supporting-ring 8 is situated radially inside the pitch circle TK of the filling elements 5 relative to the machine axis MA. On its inside, which faces the machine axis MA, the closure-element supporting-ring 8 is provided with bearing elements 10. Each bearing element 10 lies on a counter-bearing 11. The bearing elements 10 are distributed at even angular intervals about the machine axis MA.

In the embodiment shown, the closure-element supporting-ring 8 is concentric with the rotor and thus has a central axis that is coaxial with the machine axis MA. The closure-element supporting-ring 8, with its bearing elements 10, rests on the counter-bearings 11. In a manner to be described in more detail below, the closure-element supporting-ring 8 can rotate about the machine axis MA relative to the rotor 3.

Closure elements 12 lie radially on the outside relative to the machine axis MA on the closure-element supporting-ring 8. The closure elements 12 are formed as closing plates or rinsing caps, and are also arranged on the pitch circle TK (for example with their center axis) with the same pitch spacing as that of the filling elements 5. The number of closure elements 12 is equal to the number of the filling elements 5.

Figure 8:
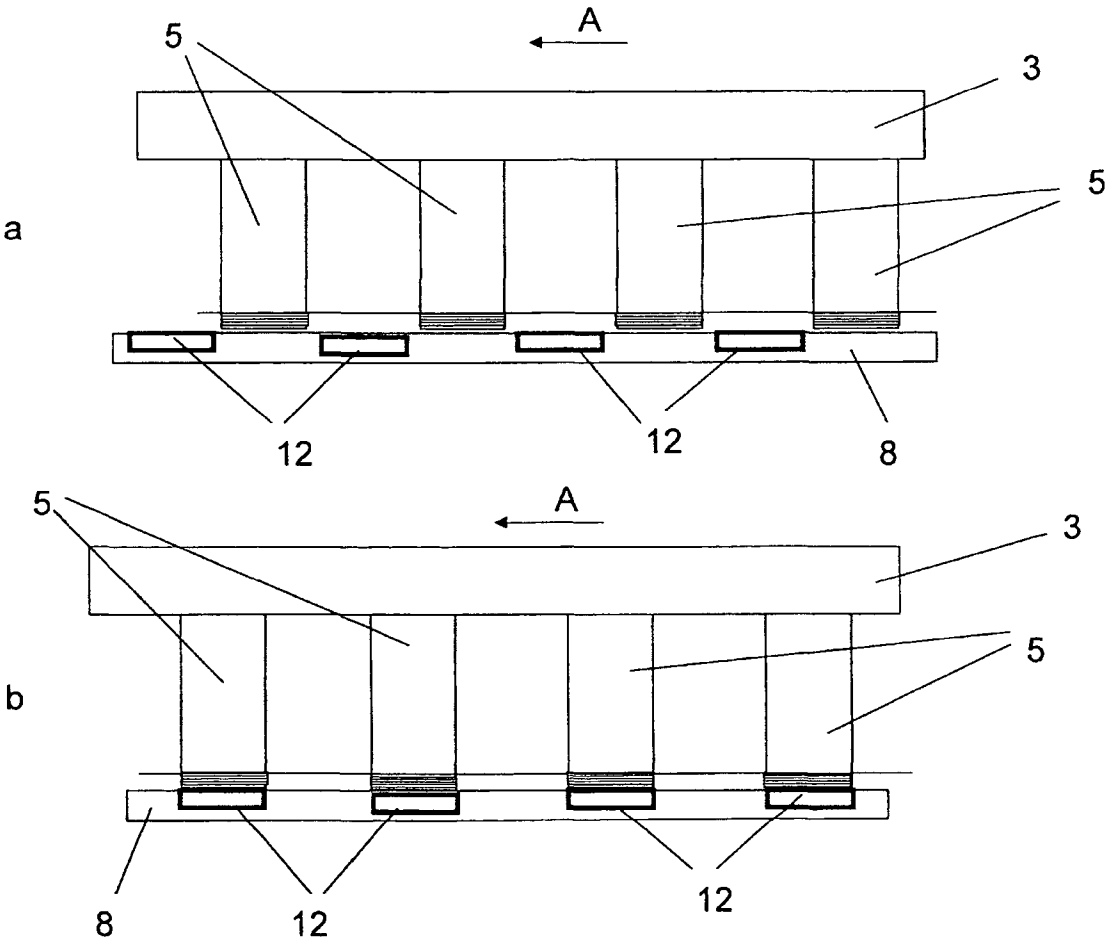
FIG. 8 shows two different operating states of the closure-element supporting-ring and respectively the closure elements present in each state.

By the relative movement between the closure-element supporting-ring 8 and the rotor 3, each closure element 12 can be moved between a non-engaged position and an engaged, or flushing position. In the non-engaged position, the closure element 12 lies between two filling elements 5 on the pitch circle TK, as shown in position A of FIG. 8. In the engaged or flushing position, the closure element 12 lies tightly against the underside of a filling element 5, as shown in position B of FIG. 8. In the engaged or flushing position, the closure element 12 seals the filling element on its underside or at the filling material outlet opening there and at any other openings for CIP cleaning and/or CIP disinfection of the filling machine 1.

In the illustrated embodiment, the closure elements 12 are arranged with their top side at the level of the underside of the filling elements 5 or slightly below this level, and with their underside above the container carrier 5.1, which defines a container carrier level. The closure elements 12 are each provided at the free end of a carrier arm 13 protruding radially outward from the closure-element supporting-ring 8 relative to the machine axis MA, which is attached to the closure-element supporting-ring 8 and in each of which is formed a channel 14 open at the top of the closure element 12 and opening into the annular fluid channel 9 common to all closure elements 12.

During the normal filling operation of the filling machine 1, in which the closure elements 12 are situated between the filling elements 5 and therefore obstruct neither the handover of the containers 2 to the filling elements 5 nor the collection of the containers 2 from the filling elements 5, nor the function of the filling elements 5, the closure-element supporting-ring 8 moves with the rotating rotor 3. In some cases, this movement of the closure-element supporting-ring 8 with the rotor 3 takes place by friction engagement between the bearing elements 10 and the counter-bearings 11. In other cases, it takes place by engagement of the bearing elements 10 with catches on counter-catches of the counter-bearings 11, or by a controllable braking or locking device acting between the rotor 3 and the closure-element supporting-ring 8.

During operation, the filling machine 1 causes relative movement between the rotor 3 and the closure-element supporting-ring 8. This movement moves closure elements 12 between their non-engaged position and their engaged position. The non-engaged position is used during the filling operation. The engaged position is used for CIP cleaning and/or CIP disinfection. The filling machine causes movement between the engaged position and the non-engaged position purely using the same drive that rotates the rotor 3 during the filling operation.

To achieve movement between the engaged position and the non-engaged position, the drive, starting from the standing rotor 3, is actuated under control such that the rotor 3 rotates by one rotation step about the machine axis MA. In some cases, the rotation step corresponds to half the pitch interval of the filling elements 5. In other cases, the rotation step corresponds to an integral odd multiple of half the pitch interval of the filling elements 5.

The rotor 3 turns in a rotation direction A in which it also turns during the filling operation. A locking-and-blocking device 15 blocks the closure-element supporting-ring 8, thus preventing it from rotating with the rotor 3. The locking-and-docking device 15 is preferably provided in a dead angle area of the rotary movement of the rotor 3 between the container outlet 6.2 and the container inlet 6.1.

Figure 6:
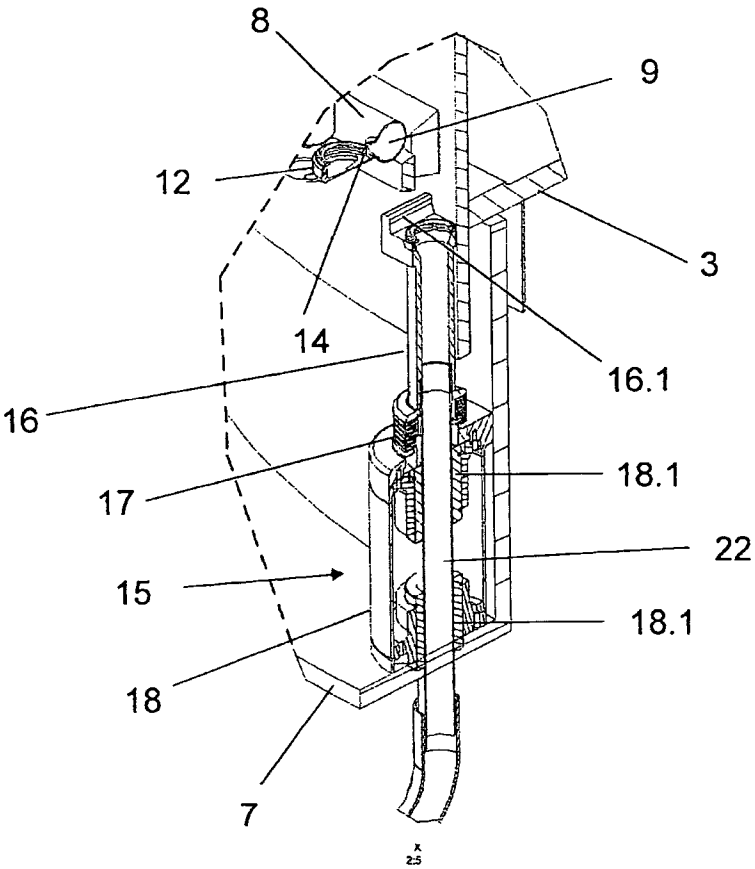
FIGS. 6 and 7 are cut-away views of the rotor and the machine frame together with a locking and docking device in various operating states of this device at the area marked "II" in FIG. 3.
Figure 7:
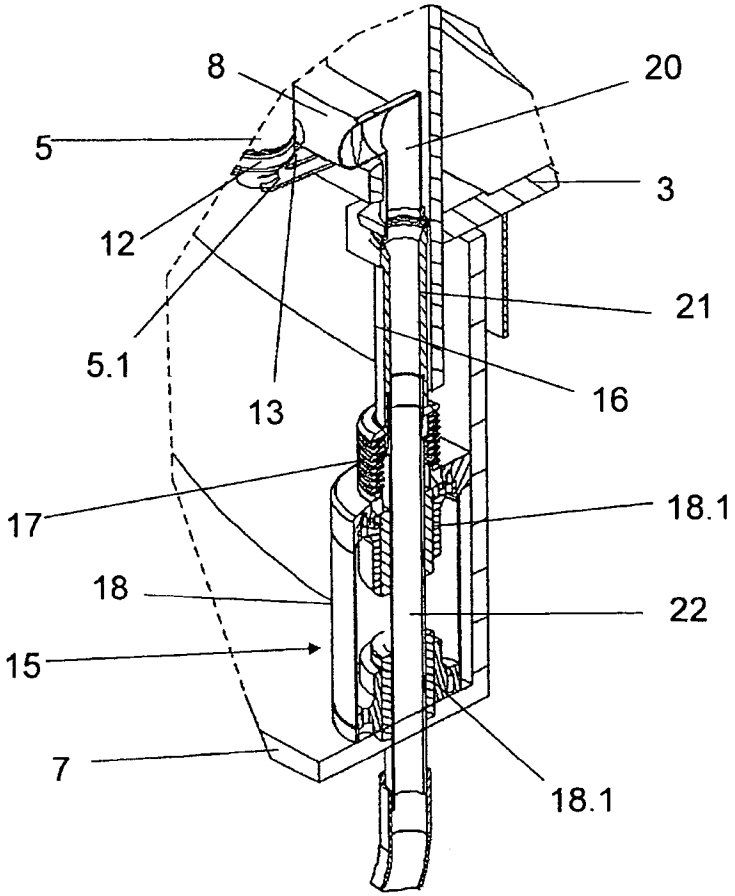

Referring to FIGS. 6 and 7, the locking-and-docking device 15 on the machine frame 7 includes a locking ram 16 that is formed from a tubular piece open at both ends and oriented with its axis parallel to machine axis MA. In a bearing bush 18.1 of a stroke element 18 provided on the machine frame 7, the locking ram 16 can be moved axially by the stroke element 18 or by another actuation device. The locking ram 16 moves axially between a first position shown in FIG. 6 and a second position shown in FIG. 7. In the first position, the locking ram 16 does not block the closure-element supporting-ring 8. In the second position, the locking ram 16 blocks the closure-element supporting-ring 8.

Gaiters 17 seal a gap between the stroke element 18 and the locking ram 16. In the first position, the top end of the locking ram 16, or a stop 16.1 provided there, lies against a counter-stop 19 that is provided on the closure-element supporting-ring 8.

In the region of the counter-stop 19, the closure-element supporting-ring 8 is also provided with a fluid coupling 20 to which a tubular connecting piece 21 can be coupled when the locking ram 16 is in the second position. The connecting piece 21 is part of an outer fluid channel 22 that is also formed in the locking ram 16. The connecting piece 21 is axially moveable relative to the axis of the locking ram 16 between an upper position and a lower position. In the upper position, a tight fluid connection exists between the fluid coupling 20 and the connecting element 21, and hence with the outer fluid channel 22. In the lower position, the connecting piece 21 is spaced from the fluid coupling 20.

During CIP cleaning and/or CIP disinfection, the channels 14, the annular fluid channel 9, and the outer fluid channel 22 connected via the connecting piece 21 collectively form a flow path for discharge or supply of the treatment medium.

The tight contact of the closure elements 12 against the filling elements 5 is achieved by wedge-shaped or sloping surfaces in the contact areas. These contact areas cause a slight lifting of the closure-element supporting-ring 8 and/or the closure elements 12 on rotation of the rotor 3 relative to the blocked closure-element supporting-ring 8.

At the end of vapor bombardment, CIP cleaning and/or CIP disinfection, when the connecting piece 21 is decoupled from the fluid coupling 20 but the closure-element supporting-ring 8 of the rotor 3 is still blocked by the locking-and-docking device 15, the rotor 3 is turned further by its drive in the rotation direction A by a step that corresponds to half a pitch interval or an integral odd multiple of half a pitch interval of the filling elements 5. Expressed differently, if the pitch interval is P, the step corresponds to $(2n+1)P/2$ for non-negative integers n. As a result, the closure-element supporting-ring 8 or its closure elements 12 are again in the non-engaged position or non-engaged state.

Lowering the locking ram 16 causes the locking-and-catching device 15 to release the closure-element supporting-ring 8 so that, on the next filling operation, the rotor 3 again carries the closure-element supporting-ring 8 along as it rotates. Due to the working method described, there is no fixed assignment of the closure elements 12 to a filling element 5. Rather, each closure element 12 cooperates with each filling element 5 after random rotary positioning of the rotor 3 relative to the closure-element supporting-ring 8.

It is evident that, for the closure-element supporting-ring 8 to be transferred from a non-engaged state to an engaged state, it must first be turned with the rotor 3 into a rotary position in which a counter-stop 19 is situated at the locking-and-docking device 15.

It is possible to distribute many locking-and-blocking devices 15 about the machine axis MA to control locking of the closure-element supporting-ring 8 and to be brought into engagement or locking with non-rotating elements, such as carrier elements of the filling machine 1. Because of such additional locking or blocking devices 15, the fluid-conductive locking-and-docking device 15 can be made less massive.

An advantage of the configuration described herein is that the relative movement necessary for transferring the closure-element supporting-ring 8 between the non-engaged state and the engaged state is achieved exclusively by the drive of the rotor 3, with the rotor 3 being turned in its normal rotation direction A. As a result, no separate drive is required to move the closure-element supporting-ring 8 or closure elements 12. In particular, it is not necessary to configure the drive of the rotor 3 so that it must be moved in opposite directions of rotation in order to transfer the closure elements 12 between the non-engaged position and the engaged position.

Another advantage is that, as a result of having one or more locking-and-docking devices 15, a fluid connection can be created between the individual closure elements 12 and the outer fluid channel 22 when the closure elements 12 are in the engaged state, namely for discharging or supplying the treatment medium.

Since the treatment medium is discharged or supplied via the outer fluid channel 22, and since the outer fluid channel 22 is only connected to the annular fluid channel 9 when the closure-element supporting-ring 8 is blocked, i.e. only when the annular fluid channels 9 and the outer fluid channel 22 are also required, no rotary movements are required for treatment medium.

The closure-element supporting-ring 8 with its closure elements 12, the guide means for this supporting ring, and the locking-and-docking device 15 have a simple structure that guarantees reduced susceptibility to fault and high operating reliability. The simplified construction also avoids areas such as niches, undercuts, and the like in which contaminants, such dirt or germs, can settle. A gaiter 17 deals the gap between the locking ram 16 and the housing of the stroke element 18. The filling machine 1 therefore fulfills the requirements for sterile filling of the filling material.

The normal filling operation is not hindered by the closure-element supporting-ring 8 and closure elements 12. The closure-element supporting-ring 8 can expand freely on heating without influencing the filling elements 5 or container carriers provided there.

After return to the non-engaged state, the channels 14 are open at the top of the closure element 12, and the annular fluid channel 9 is open at least at the fluid coupling 20. As a result, treatment-medium residue can flow out and the channels are completely dry during normal filling operation. This tends to prevent contamination.

The invention has been described above with reference to an exemplary embodiment. Numerous changes and derivations are possible without departing from the scope of the invention, which is defined by the appended claims.

Having described the invention, and a preferred embodiment thereof, what is claimed as new, and secured by Letters Patent is:

1. An apparatus comprising a filling machine for filling containers with a filling material, wherein said filling machine comprises a rotor, filling elements, a closure-element supporting-ring, closure elements, a stationary machine frame, a filling-material discharge opening, and a locking device, wherein said locking device is attached to said machine frame, wherein said stationary machine frame does not rotate with said rotor, wherein said rotor defines a vertical machine axis, wherein said rotor defines a pitch circle, wherein said pitch circle surrounds said machine axis, wherein said pitch circle is concentric with said machine axis, wherein said rotor is drivable to rotate about said vertical machine axis by a rotor drive, wherein said filling elements are provided on said rotor at even pitch intervals on said pitch circle, wherein said closure-element supporting-ring is concentric with said machine axis, wherein each closure element closes a corresponding filling element on an underside thereof during at least one of cleaning and disinfection of said filling machine, wherein each filling element comprises a filling material discharge opening, wherein relative movement between said closure-element supporting-ring and said rotor moves said closure elements between a non-engaged state and an engaged state, wherein, in said non-engaged state, said closure elements are arranged on said pitch circle between said filling elements, wherein in said engaged state, each closure element is situated on an underside of a corresponding filling element, wherein relative movement between said closure-element supporting-ring and said rotor is generated by said rotor drive, and wherein said locking device is configured to block co-rotation of said closure-element supporting-ring and said rotor in order cause said closure elements to transition between said non-engaged state and said engaged state.

2. The apparatus of claim 1, wherein said locking device is one of a plurality of locking devices, wherein said locking devices are distributed about said machine axis, wherein each of said locking devices in said plurality of locking devices is configured to block co-rotation of said closure-element supporting-ring and said rotor in order cause said closure elements to transition between said non-engaged state and said engaged state.

3. The apparatus of claim 1, wherein said closure-element supporting-ring is connected to said rotor so that rotation of said rotor results in rotation of said closure-element supporting ring.

4. The apparatus of claim 3, wherein said closure-element supporting-ring is connected to said rotor by friction engagement.

5. The apparatus of claim 3, wherein said closure-element support-ring is connected to said rotor by a controllable coupling device.

6. The apparatus of claim 1, wherein said closure-element supporting-ring lies on a counter-bearing of said rotor with a bearing element that protrudes radially, relative to said vertical machine axis, from said closure-element supporting-ring, and wherein said counter-bearing is an annular structure that surrounds said machine axis.

7. The apparatus of claim 1, further comprising a locking device, wherein said closure-element supporting-ring comprises a first fluid channel that connects to openings on a closure element for discharge or supply of fluid, wherein said locking device connects said first fluid channel to a second fluid channel for drainage of said fluid when said closure-element supporting-ring is blocked, and wherein said fluid is selected from the group consisting of condensate, cleaning medium, and disinfection medium.

8. The apparatus of claim 1, further comprising a locking device, wherein said closure-element supporting-ring comprises a first fluid channel that connects to openings on a closure element for discharge or supply of fluid, wherein said locking device forms part of a second fluid channel that is provided on said machine frame, and wherein said second fluid channel permits discharge of said fluid, and wherein said fluid is selected from the group consisting of condensate, cleaning medium, and disinfection medium.

9. The apparatus of claim 1, wherein said locking device is disposed in a dead-angle area of rotary movement of said rotor, wherein said dead-angle area is disposed between a container outlet and a container inlet.

10. The apparatus of claim 1, further comprising a locking device, wherein said locking device is disposed in a dead-angle area of rotary movement of said rotor, said dead-angle area being disposed between a container outlet and a container inlet.

11. The apparatus of claim 1, wherein the number of closure elements is equal to the number of filling elements.

12. The apparatus of claim 1, wherein said closure-element supporting-ring is arranged inside said pitch circle.

13. The apparatus of claim 1, wherein said closure elements are arranged at a level between undersides of said filling elements and a container carrier level.

* * * * *